US006752647B1

(12) United States Patent
Lin

(10) Patent No.: US 6,752,647 B1
(45) Date of Patent: Jun. 22, 2004

(54) ROTARY INSULATION DISPLACEMENT CONNECTOR

(75) Inventor: Yen Lin Lin, Lu Chou (TW)

(73) Assignee: Jyh Eng Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 10/428,027

(22) Filed: May 2, 2003

(51) Int. Cl.[7] ..... H01R 4/24
(52) U.S. Cl. ..... 439/412; 439/418
(58) Field of Search ..... 439/380–425

(56) References Cited

U.S. PATENT DOCUMENTS 4,423,918 A * 1/1984 Filreis et al. ..... 439/412
5,096,437 A * 3/1992 Levy ..... 439/411
5,989,056 A * 11/1999 Lange et al. ..... 439/412
6,443,756 B1 * 9/2002 Hagmann et al. ..... 439/402
6,568,952 B1 * 5/2003 Tomasino ..... 439/411

* cited by examiner

*Primary Examiner*—Hien Vu
(74) *Attorney, Agent, or Firm*—Troxell Law Office PLLC

(57) ABSTRACT

The connector has: an electric-communication connecting base with an end piece which is formed on the front face thereof an annular member with an outer peripheral thread, the pins having piercing ends exposed each for a set length from the annular member and a reduced annular portion on the front end of the annular member; a conductor extending-through seat made of insulation material having an opening outer and an inner ring extending from the end face of the seat to the annular member, so that an annular groove formed by the outer and inner rings being able to slip over the reduced annular portion, conductors being bent and positioned on the outer and inner rings; and a rotation control member having an inner thread on its inner side facing to the thread on the annular member to screw connect with the conductor extending-through seat having the conductors positioned to axially press and thrust the conductors for piercing and connecting.

5 Claims, 6 Drawing Sheets

ROTARY INSULATION DISPLACEMENT CONNECTOR

BACKGROUND OF THE INVENTION

1. Field of the Invention

The present invention is related to a rotary insulation displacement connector (IDC) for an electric-communication connecting base, and especially to a rotary insulation displacement connector that can pierce and connect conductors fast and firm.

2. Description of the Prior Art

An electric-communication connecting base adopting piercing pins of a rotary insulation displacement connector (IDC) has the advantage of easiness for processing, with which connecting base all conductors are placed at a plurality of piercing pins once for all; and by pressing the pins into the conductors, the outer insulation layers of the latter are broken, the metallic cores of the latter can thereby contact with the metallic piercing pins.

A conventional piercing and connecting operation for piercing pins with conductors generally includes positioning an electric-communication connecting base, then placing the conductors on piercing ends of the piercing pins in the shape of a fork. Now, the conductors are pressed with a tool of a corresponding one among different specifications to a predetermined depth by the fork-shaped piercing ends, and the piercing and connecting operation can then be completed.

A plurality of defects has been derived from the process of a conventional piercing and connecting operation, the defects include the necessity of using tools of different specifications and slow operation of processing etc. And using a vertical down pressing mode for piercing and connecting conductors often makes the situation of deviation to fail to concentrically pierce the conductors; the structure of the whole of the conductors will be unfirm after connecting to thereby influence the quality of transmission of the entire electric-communication connecting base.

SUMMARY OF THE INVENTION

The object of the present invention is to provide a rotary insulation displacement connector (IDC) for an electric-communication connecting base that can pierce and connect conductors faster and more convenient, and the structure of the whole of the conductors will be firmer and more reliable after piercing and connecting the conductors, this can help to elevate the quality of transmission of the entire electric-communication connecting base.

To obtain the object, the electric-communication connecting base of the present invention is provided on the front end thereof with an end piece, a plurality of piercing pins are positioned on the end piece; the end piece is formed on the front face thereof an annular member with an outer peripheral thread, the piercing ends of the piercing pins are exposed each for a set length from the annular member and a reduced annular portion on the front end of the annular member; a conductor extending-through seat made of insulation material is provided with an opening outer ring and an opening inner ring extending from the end face of the seat to the annular member of the end piece, so that an annular groove formed by the outer and inner rings can be slipped over the reduced annular portion. The outer and inner rings respectively have clamping slits in the amount in coincident with that of the conductors and the piercing pins. The conductor extending-through seat has a reduced hollow guide pipe provided on an end face thereof to form a central conductor extending hole. A rotation control member is provided on its inner side facing to the thread on the outer periphery of the annular member with an inner thread, and is provided on its end face with a through hole in opposition to the reduced hollow guide pipe on the conductor extending-through seat. The conductor extending-through seat makes the conductors bent and positioned to connect to the reduced annular portion on the front end of the annular member, so that the rotation control member is screw connected with the outer periphery of the annular member.

The present invention will be apparent after reading the detailed description of the preferred embodiment thereof in reference to the accompanying drawings.

DETAILED DESCRIPTION OF THE PREFERRED EMBODIMENT

Figure 1:
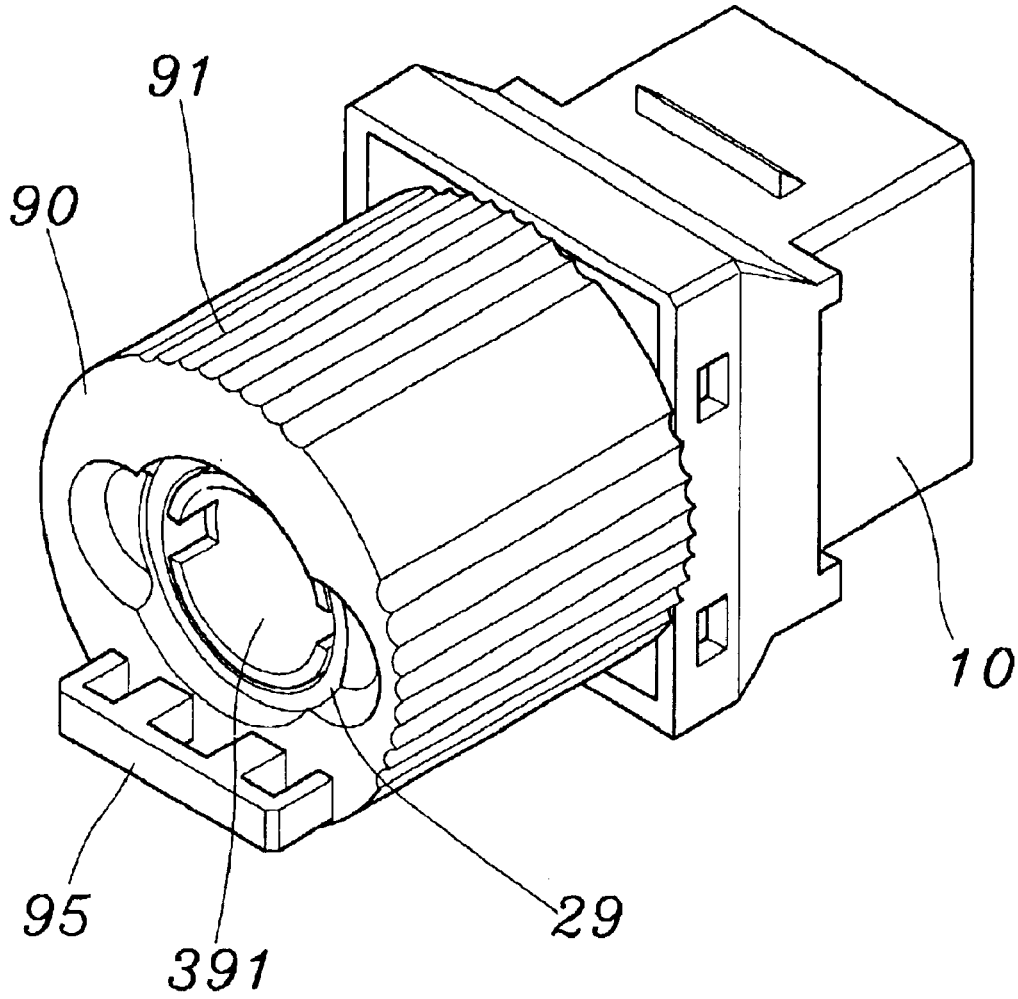
FIG. 1 is a perspective view of a preferred embodiment of the present invention.
Figure 2:
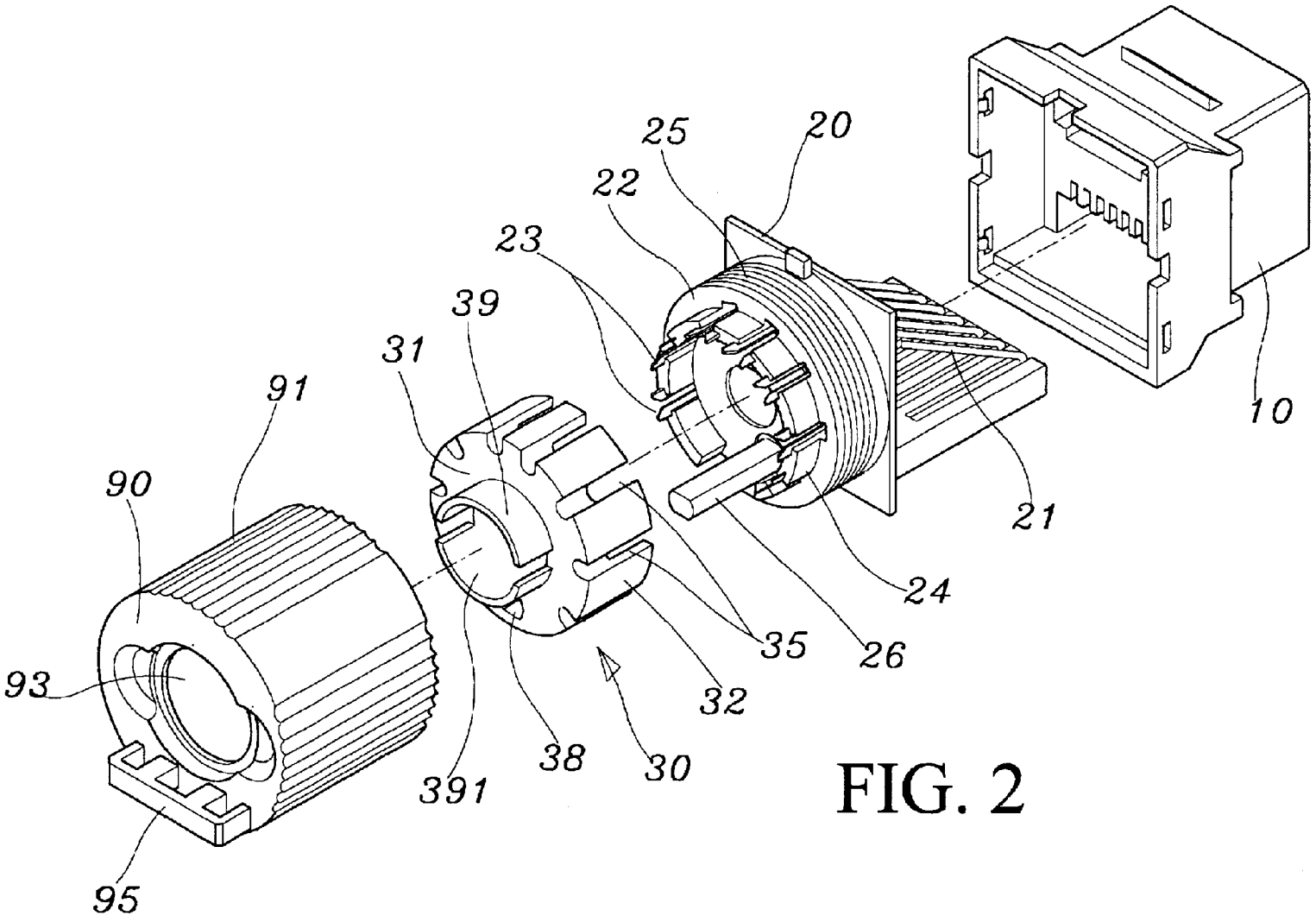
FIG. 2 is an analytic perspective view showing the elements in FIG. 1.

Referring firstly to FIGS. 1 and 2, an electric-communication connecting base 10 of the present invention is provided on the front end thereof with an end piece 20; a plurality of piercing pins 21 are positioned on the end piece 20. The end piece 20 is formed on the front face thereof an annular member 22, piercing ends 23 of the piercing pins 21 are exposed for a set length from the annular member 22 and a reduced annular portion 24 on the front end of the annular member 22. In this embodiment, the annular member 22 is provided with an outer peripheral thread 25, a guide member 26 with a predetermined length is extended from the end face of the annular member 22.

Figure 3:
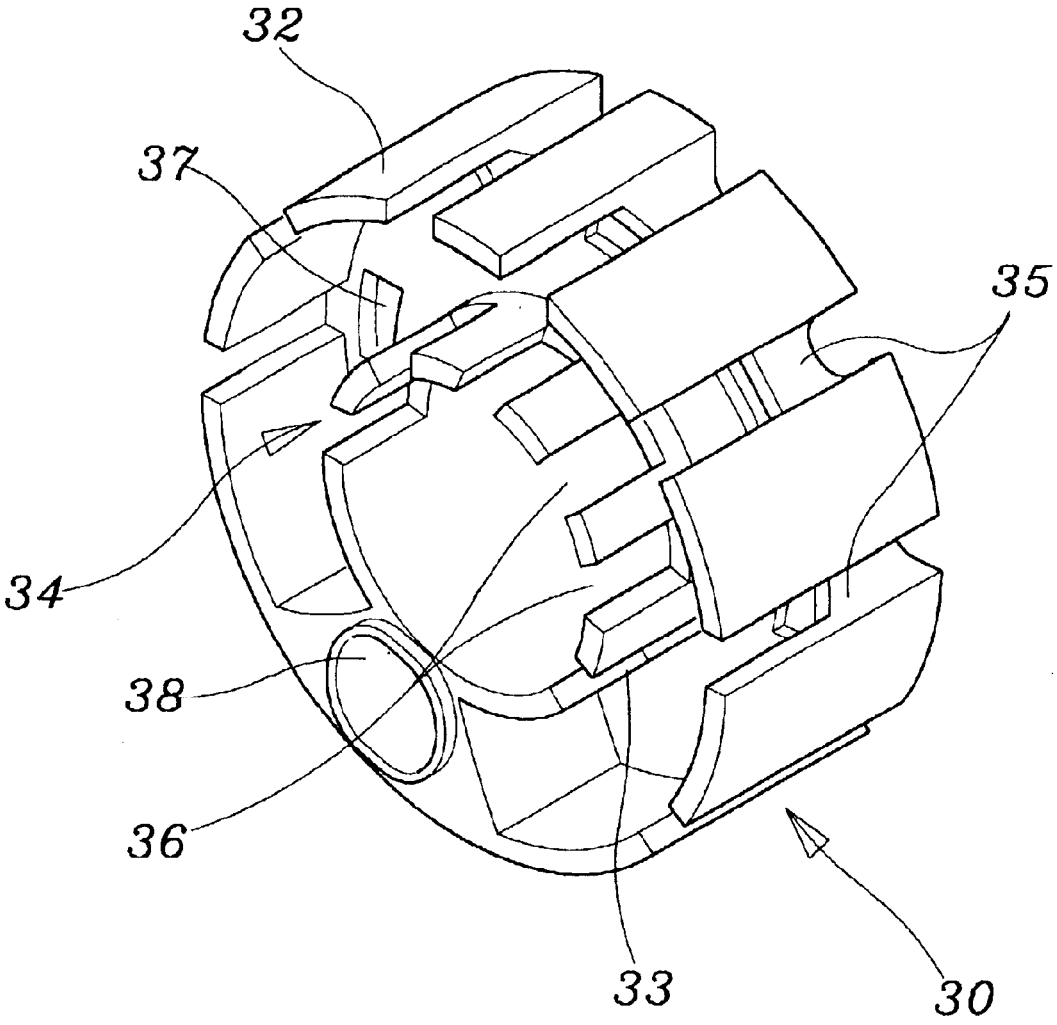
FIG. 3 is a perspective view showing a conductor extending-through seat as shown in FIG. 2 but in a contrary direction.

A conductor extending-through seat 30 made of insulation material is provided, as shown in FIGS. 2 and 3, with an opening outer ring 32 and an opening inner ring 33 extending from the end face 31 of the seat 30 to the annular member 22 of the end piece 20, so that an annular groove 34 (referring to FIG. 3) formed by the outer and inner rings 32, 33 can be slipped over the reduced annular portion 24. The outer and inner rings 32, 33 respectively have clamping slits 35, 36 in the amount in coincident with that of the conductors and the piercing pins 21. An inner side of and in opposition to the end face 31 is provided with a plurality of mutually separated positioning slots 37 which are opposite to the piercing ends 23, and with a guide hole 38 in corresponding in position with the guide member 26 extended from the end face of the annular member 22.

Figure 4:
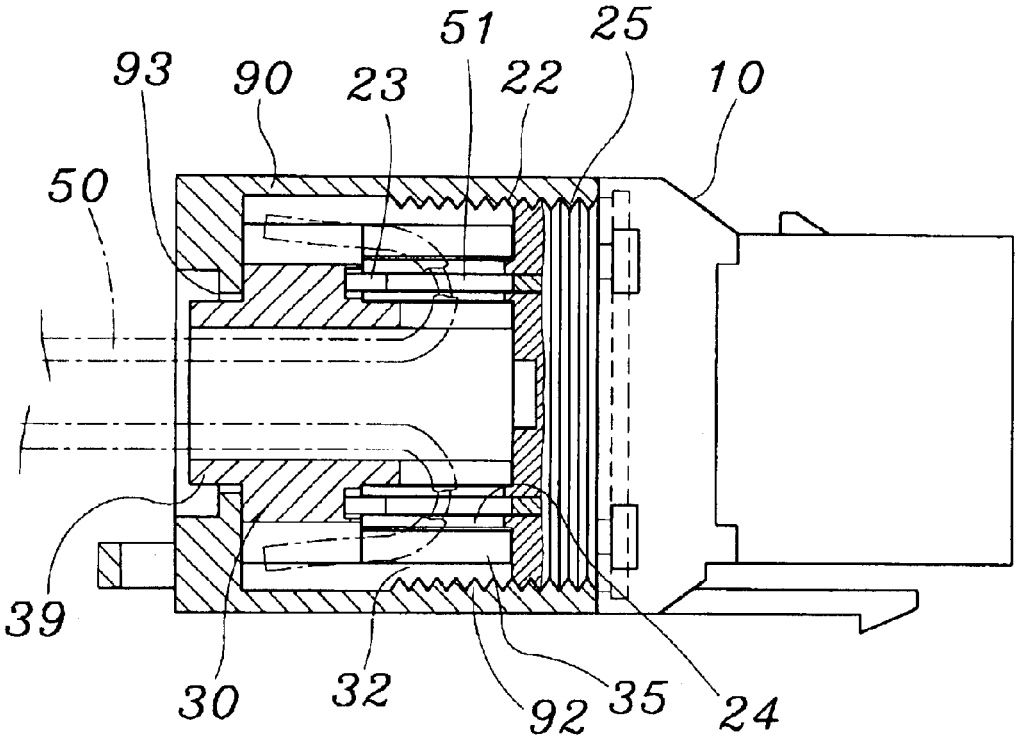
FIG. 4 is a sectional view taken from FIG. 1.

Referring to FIGS. 2 and 4, a rotation control member 90 is preferably provided with an outer periphery 91 knurled for convenient rotation, and is provided on its inner side facing to the outer peripheral thread 25 on the outer periphery 91 of the annular member 22 with an inner thread 92 (referring to FIG. 4); and is provided on its end face with a through hole 93 in opposition to the reduced hollow guide pipe 39 on the conductor extending-through seat 30. In this embodiment, the rotation control member 90 can be provided near the lower rim thereof with a conductor binding seat 95 or some related grounding structure.

Figure 5:
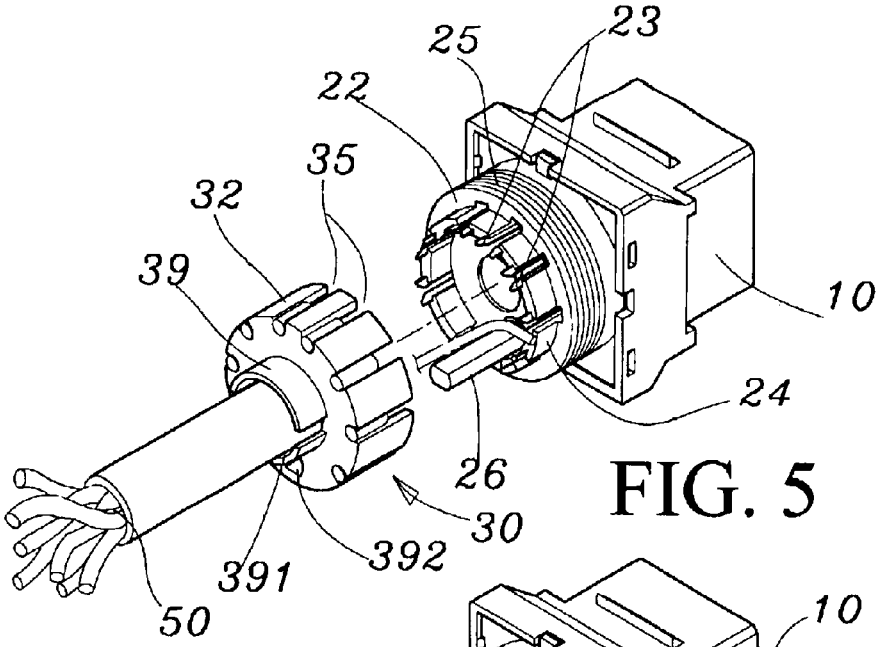
FIGS. 5–7 are perspective views showing a series of actions in use of the present invention.
Figure 6:
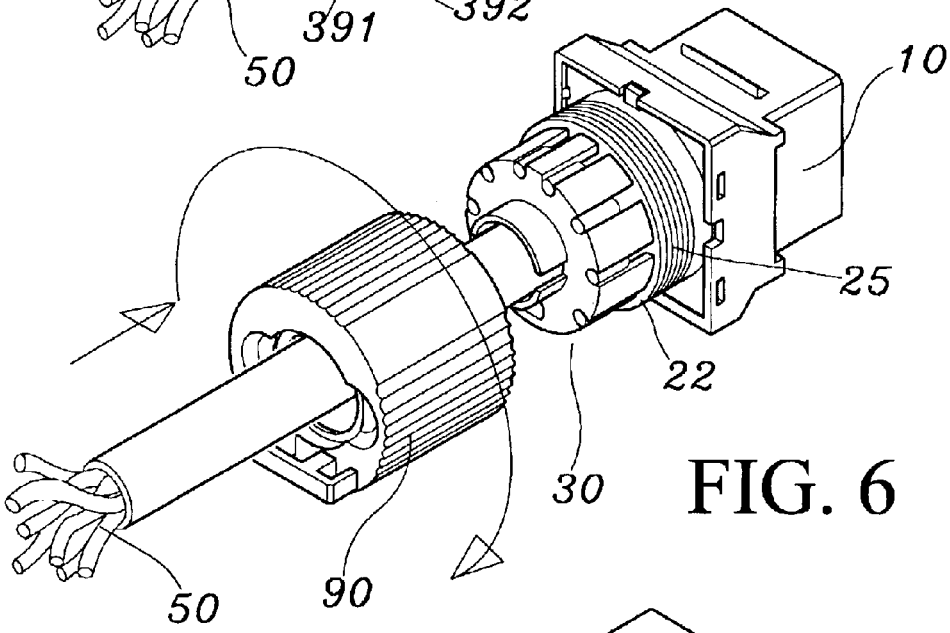
Figure 7:
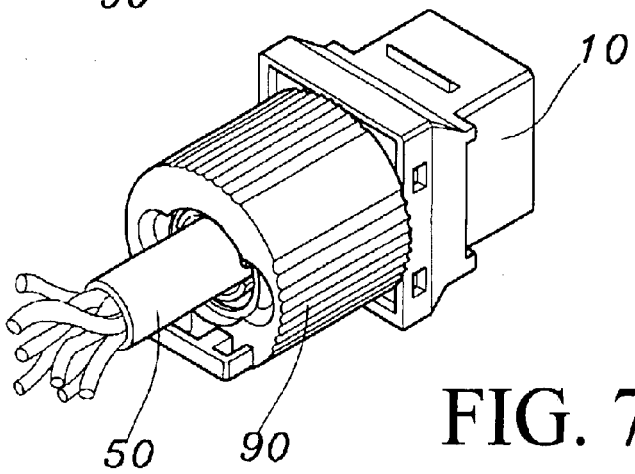

As shown in FIGS. 5–7, a bundle of conductors 50 to be connected have their ends bent and positioned in the clamping slits 35, 36 of the outer and inner rings 32, 33 respectively (referring to FIGS. 4, 5); the conductor extending-through seat 30 having the conductors extended and positioned therein is aligned with the reduced annular portion 24 of the annular member 22 on the end piece 20, thereby the reduced annular portion 24 and the piercing ends 23 of the piercing pins 21 enter the annular groove 34 formed by the outer and inner rings 32, 33 (referring to FIG. 6); at this time, the rotation control member 90 can be slipped over the conductor extending-through seat 30 to be ready for rotating and connecting of the inner thread 92 onto the outer peripheral thread 25 of the annular member 22. During continuous rotation connecting of the inner thread 92 of the rotation control member 90 with the outer peripheral thread 25 of the annular member 22, the conductors 50 positioned in the clamping slits 35, 36 on the outer and inner rings 32, 33 of the conductor extending-through seat 30 will be pushed toward the piercing ends 23 of the piercing pins 21 continuously by a force to pierce the insulation layers of them, and thereby to make the operation of connection of the metallic cores 51 (referring to FIG. 4) of the conductors 50 with the metallic piercing pins 23 of the piercing pins 21 (referring to FIGS. 4, 7). During the process of piercing and connecting, the ends of the metallic piercing pins 23 of the piercing pins 21 get to the mutually separated positioning slots 37 of the conductor extending-through seat 30 as their terminal positions of the operation of piercing and connecting.

Figure 8:
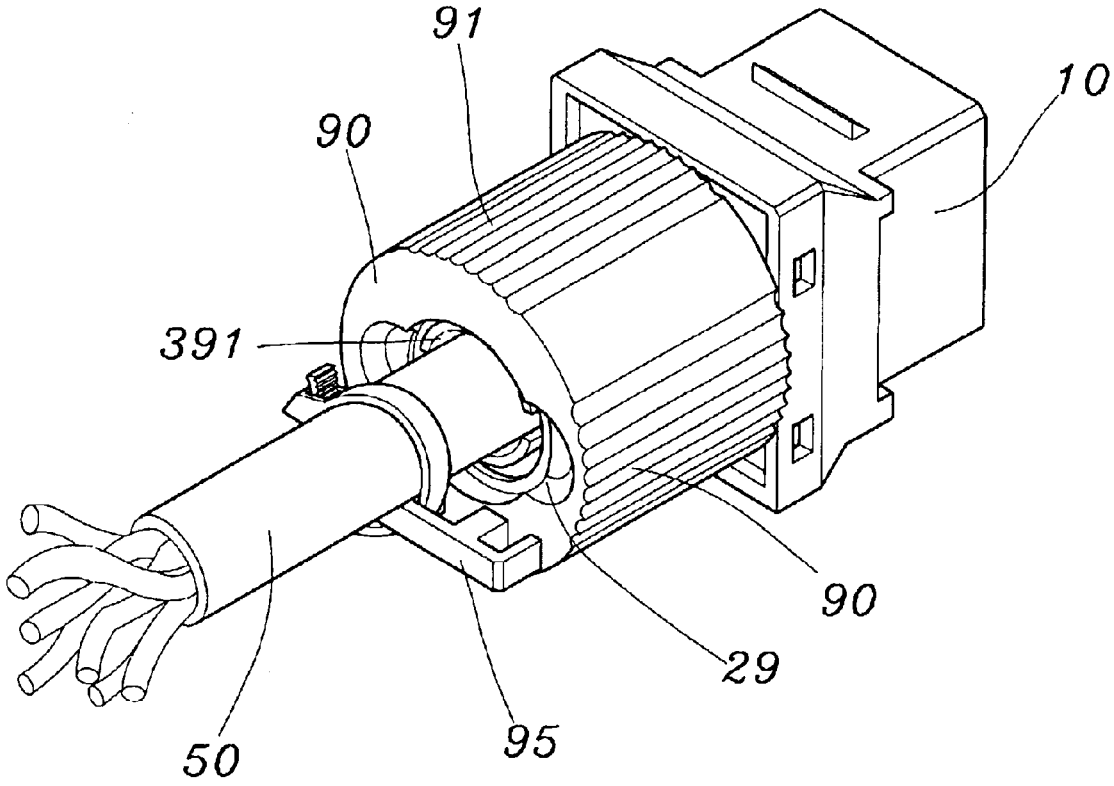
FIG. 8 is a schematic perspective view showing the state of binding or grounding the conductors.

FIG. 8 shows that the rotation control member 90 provided with a conductor binding seat 95 can certainly be a tidying device of the conductors 50 or can be provided with a related grounding structure.

The above stated improved structure of the present invention has the conductors to be connected positioned in the first place in the conductor extending-through seat and then rotated with the rotation control member for connecting, it needs no tool in operation, rather, the operation can be faster and more convenient; and the operation of axial pressing and thrusting the conductors for piercing and connecting can be firmer and more reliable, this can help to elevate the quality of transmission of the entire electric-communication connecting base.

The preferred embodiment cited above is only for illustrating of the present invention; it will be apparent to those skilled in this art that various modifications or changes can be made to the elements of the present invention without departing from the spirit of this invention. Accordingly, all such modifications and changes also fall within the scope of the appended claims.

What is claimed is:

1. A rotary insulation displacement connector (IDC) for an electric-communication connecting base, said connector comprises:

in a front end of said connector with an end piece on which a plurality of piercing pins are positioned, said end piece being formed on a front face thereof, an annular member with an outer peripheral thread including a reduced annular portion, piercing ends of said piercing pins being exposed for a set length extending from a front end of said annular member to the reduced annular portion on the front end of said annular member;

a conductor extending-through seat made of insulation material provided with an opening outer ring and an opening inner ring extending from an end face of said conductor extending-through seat toward said annular member of said end piece, an annular groove formed by said outer and inner rings being adapted to slipping over said reduced annular portion; said outer and inner rings respectively having clamping slits in the amount in coincident with conductors of a wire and said piercing pins, said conductor extending-through seat having a reduced hollow guide pipe provided on an end face thereof to form a central conductor extending hole; and a rotation control member provided on its inner side facing to said outer peripheral thread of said annular member with an inner thread, and provided on its end face with a through hole in opposition to said reduced hollow guide pipe on said conductor extending-through seat;

said conductor extending-through seat having the conductors extended and positioned therein is aligned with the reduced annular portion of the annular member on the end piece, thereby the reduced annular portion and the piercing ends of the piercing pins enter the annular groove formed by the outer and inner rings, so that said rotation control member is screw connected with said outer periphery of said annular member.

2. The rotary insulation displacement connector for an electric-communication connecting base as claimed in claim 1, wherein a guide member with a predetermined length is extended from said end face of said annular member; a guide hole in corresponding in position with said guide member is provided on said conductor extending-through seat.

3. The rotary insulation displacement connector for an electric-communication connecting base as claimed in claim 1, wherein said conductor extending-through seat is provided on an inner side of and in opposition to said end face with a plurality of mutually separated clamping slits which are opposite to said piercing ends.

4. The rotary insulation displacement connector for an electric-communication connecting base as claimed in claim 1, wherein said rotation control member is provided near the lower rim thereof with a conductor binding seat.

5. The rotary insulation displacement connector for an electric-communication connecting base as claimed in claim 1, wherein said rotation control member is provided near the lower rim thereof with a grounding structure.

* * * * *